US009716000B2

(12) United States Patent
Haufler et al.

(10) Patent No.: US 9,716,000 B2
(45) Date of Patent: Jul. 25, 2017

(54) LENS PULSING APPARATUS AND METHOD

(71) Applicant: DH Technologies Development PTE Ltd., Singapore (SG)

(72) Inventors: Robert Haufler, Toronto (CA); Andrei Sonoc, Richmond Hill (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 15/107,498

(22) PCT Filed: Dec. 12, 2014

(86) PCT No.: PCT/IB2014/002792

§ 371 (c)(1),
(2) Date: Jun. 23, 2016

(87) PCT Pub. No.: WO2015/101823

PCT Pub. Date: Jul. 9, 2015

(65) Prior Publication Data

US 2016/0314955 A1 Oct. 27, 2016

Related U.S. Application Data

(60) Provisional application No. 61/922,301, filed on Dec. 31, 2013.

(51) Int. Cl.

| | |
|---|---|
| ***H01J 49/22*** | (2006.01) |
| ***H01J 49/26*** | (2006.01) |
| ***H01J 49/06*** | (2006.01) |
| ***H01J 49/40*** | (2006.01) |

(52) U.S. Cl.
CPC ..... *H01J 49/067* (2013.01); *H01J 49/062* (2013.01); *H01J 49/40* (2013.01)

(58) Field of Classification Search
USPC ..... 250/281, 282, 283, 286, 287
See application file for complete search history.

(56) References Cited

U.S. PATENT DOCUMENTS

| | | | | |
|---|---|---|---|---|
| 2004/0031918 | A1* | 2/2004 | Schoen | H01J 49/0009 250/282 |
| 2008/0142705 | A1* | 6/2008 | Schwartz | H01J 49/0045 250/292 |
| 2009/0065692 | A1 | 3/2009 | Javahery et al. | |
| 2010/0019143 | A1 | 1/2010 | Dobson et al. | |
| 2012/0161029 | A1 | 6/2012 | Makarov et al. | |
| 2013/0181125 | A1* | 7/2013 | Guna | H01J 49/025 250/282 |
| 2013/0306856 | A1 | 11/2013 | Trimpin et al. | |
| 2013/0306861 | A1 | 11/2013 | Papanastasiou et al. | |
| 2015/0021468 | A1* | 1/2015 | Steiner | H01J 49/005 250/281 |

OTHER PUBLICATIONS

International Search Report and Written Opinion for PCT/IB2014/002792 mailed Mar. 30, 2015.

* cited by examiner

*Primary Examiner* — Nicole Ippolito

(57) ABSTRACT

A lens pulsing apparatus and method for transferring ions in a mass spectrometry system from an area of high pressure to an area of low pressure which includes a gating apparatus that contains multiple electrostatic lenses. Each of the lenses operates at different voltages. The first lens operates at a predetermined fixed voltage and the second lens operates between two different voltages.

13 Claims, 4 Drawing Sheets

LENS PULSING APPARATUS AND METHOD

RELATED APPLICATION

This application claims the benefit of U.S. Patent Application Ser. No. 61/922,301, filed Dec. 31, 2013, the content of which is incorporated by reference herein in its entirety.

FIELD

The teachings described herein relate to lens pulsing in mass spectrometry analysis.

BACKGROUND

Transporting of ions through stages in mass spectrometers is commonly performed using several interfacing apparatus. In some cases, gating mechanisms can be utilized to control the flow of ions between the various stages. A skimmer cone consisting of a large cone shaped disc that contains a small hole or aperture at the centre is used to select ions that may be radially separated. Generally ions from the central portion of an ion beam are selected for transmission with the remaining ions being removed. The pulsing of the skimmer voltage can be utilized to introduce an artificial duty cycle to cause modulation of an ion beam which can reduce the total ion current in exceptionally bright beams. Such pulsing consists of switching the voltage of the skimmer between two voltages, one in which ions can pass through the skimmer and one in which the ions cannot. The phenomenon of skimmer pulsing is mass dependent and has also exhibited surprisingly non-linear behavior in some cases.

In particular, the linearity of an ion signal seen when pulsing a single gating lens over a wide duty cycle range is not very good at lower duty cycles. This affects fill time linearity on the quardupole trapping instruments and ITC (Total ion current) linearity on Time-of-Flight mass spectrometer instruments.

It has been discovered that this deviation from linearity is caused by ion mobility effects. The gating effect caused by the presence of devices such as a skimmer lens generates an axial electric field that penetrates upstream and causes a mobility dependent depletion of ions when regions of higher pressure exist. This phenomenon is more easily seen when the axial gas velocity is low and ion mobility effects are at their greatest, such as when the orifice diameter of the gating lens is small.

The normal situation is conceptually represented in FIG. 1. When the stopping potential is applied to the gating lens (labeled IQ0), a zone is created (zone of perturbation) on both sides of the lens where ions therein have their trajectories spoiled such that they are deflected away from a stable trajectory and are either ejected or contact one of the rods and will therefore not pass on to the next section of the analyzer. In particular, the field created on the high pressure side (left side) causes the ions with high mobility to deviate from an acceptable to an unacceptable trajectory preferentially relative to low mobility ions.

This results in the presence of non-linear behavior when the modulation frequency is varied. This manifests itself as a non-linear relationship between intensity counts and the time period in which the stopping potential is applied. With all other things being equal, a linear relationship between intensity and modulation frequency would be expected. This non-linear behavior is observed when the IQ0 lens ID is small. In this case the axial velocity of the ions due to the gas flow will be lower and the effect of the electric field will have a proportionally larger effect on the combined forces (gas flow+electrodynamics) on the ion motion.

SUMMARY

It has been found that the ion mobility effects generated by a gating lens can be mitigated by creating a more sharply defined electric gating field by the use of a two or more element gating lens instead of a single flat lens or cone (ie, skimmer) lens.

In various embodiments, only ions downstream of the gating lens on the lower pressure side of the lens will experience the field created when the dual lens is energized. Since the ion mobility properties scale with pressure, lower mobility effects will exist in these lower pressure environments.

The within describe teachings provide a lens providing two functions. The lens separates a high pressure zone where mobility effects dominate from a low pressure zone where electrostatic effects dominate and the lens also can effectively modulate ions.

In various embodiments, the dual lens IQ0 ion optic produces good linearity even for low duty cycles.

In various embodiments, improved fill linearity for ion traps and potentially higher score in identification of compounds in triple-TOF instruments as a result of improved ITC linearity is expected.

In various embodiments, a method for transmitting ions in a mass spectrometer from a region of higher pressure to a region of lower pressure is provided comprising passing the ions through a gating apparatus disposed between said higher pressure region and said lower pressure region, the gating apparatus comprising first and second electrostatic lenses, each of said lenses being operably controlled by one or more controllers capable of maintaining different voltages on each of said lenses, wherein the first lens is disposed adjacent to the region of higher pressure and having a voltage that is fixed at a predetermined value that allows traversal of ions through the first lens, and the second lens is disposed adjacent to the region of lower pressure and being situated downstream from said first lens, said second lens having a voltage that varies between at least two different voltages wherein in the first voltage, the ions can traverse through said second lens and in said second voltage, the ions are preventing from traversing through said second lens.

In various embodiments, a mass spectrometer device is provided which includes an ion guide operating at a first pressure, an ion trap operating at a second pressure that is lower than the first pressure, a gating apparatus disposed between said ion guide and said ion trap for transmitting ions from said ion guide to said ion trap, said gating apparatus comprising a first electrostatic lens and a second electrostatic lens, the first lens being situated adjacent to the ion guide and the second lens being adjacent to said ion trap, at least one controller for operably controlling the voltages on each of the first and second lens separately, wherein the controller is configured to maintain the first lens at a predetermined voltage that allows traversal of ions through said first electrostatic lens and the second lens in at least two different voltages in which at the first voltage, ions can traverse through said second lens and at said second voltage, the ions are preventing from traversing through said second lens.

In various embodiments, a mass spectrometer device is provided which includes an ion guide operating at a first pressure, a Time-of-Flight (TOF) mass spectrometer operating at a second pressure that is lower than the first pressure, a gating apparatus disposed between said ion guide and said TOF mass spectrometer for transmitting ions from said ion guide to said TOF mass spectrometer, said gating apparatus comprising a first electrostatic lens and a second electrostatic lens, the first lens being situated adjacent to the ion guide and the second lens being adjacent to said TOF mass spectrometer, at least one controller for operably controlling the voltages on each of the first and second lens separately, wherein the controller is configured to maintain the first lens at a predetermined voltage that allows traversal of ions through said first electrostatic lens and the second lens in at least two different voltages in which at the first voltage, ions can traverse through said second lens and at said second voltage, the ions are preventing from traversing through said second lens.

In various embodiments, a third electrostatic lens is disposed downstream from the second lens and operates at a predetermined value that allows traversal of ions through the third lens.

In various embodiments, the region of higher pressure is in an atmospheric pressure ion guide.

In various embodiments, the region of lower pressure is in a Q0 stage of a tandem mass spectrometer.

In various embodiments, the region of lower pressure is in a quadrupole ion trap.

In various embodiments, the region of lower pressure is in a TOF mass spectrometer.

In various embodiments, the gating apparatus comprises a third lens disposed downstream from said second lens.

In various embodiments, the voltages on said third and first lenses are the same.

DESCRIPTION OF VARIOUS EMBODIMENTS

While various embodiments are particularly described below, it would be appreciated that such embodiments have been presented for the purposes of illustration and description. These embodiments are not intended to be exhaustive or to limit the claimed inventions to the precise embodiments disclosed. As would be appreciated, modifications and variations are possible in light of the disclosed embodiments or may be acquired from practicing the invention. For example, while embodiments have been specifically disclosed describing a dual lens configuration, it would be appreciated that lens configurations where more than two lens would also benefit from the within described invention and could be similarly utilized and created by the person of ordinary skill. In addition, while the below described benefits are distinctly described with respect to a TOF device, it would be appreciated that such benefits are also derivable from a similar use in a quadrupole trapping device. While in a TOF device, the gating effects used with respect to the present invention are used to primarily avoid oversaturation of the detector with bright ion beams, the use in an ion trap can be used to simulate faster speeds by reducing fill times to a fraction of the normal fill times (For example, reducing fill times from 2 ms, down to 0.05 ms). Such benefits reduce space-charge effects.

Figure 1:
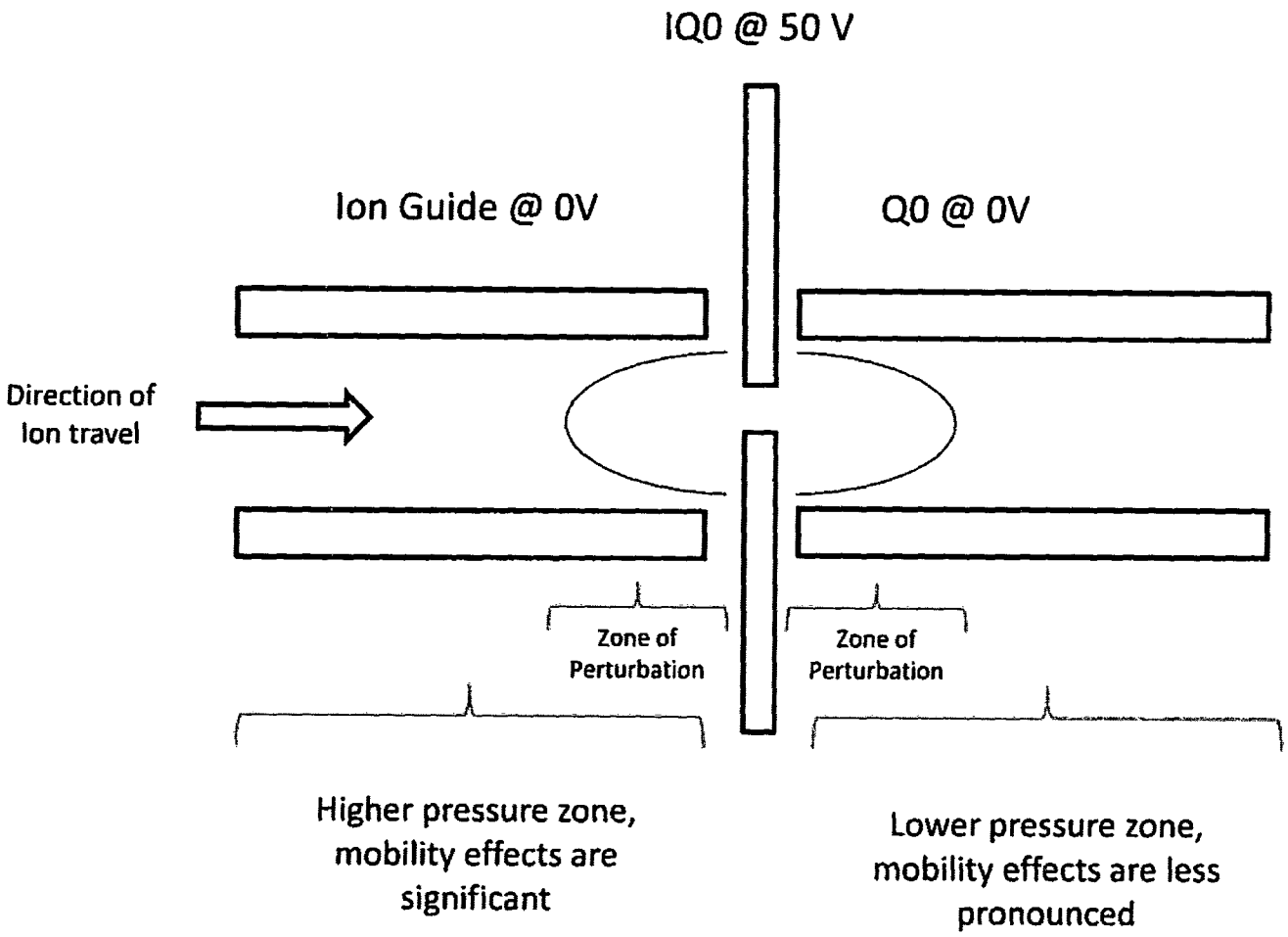
FIG. 1 depicts a typical layout with a prior art gating lens.

FIG. 1 show the layout of a conventional gating mechanism that operates between an ion guide and the first stage of a tandem mass spectrometer, referred to commonly in the art as Q0. In operation, ions from an ion source travel from left to right in the figure. Ions are transported in a quadrupole type ion guide at atmospheric pressure that is operating at 0V. The Q0 stage of the tandem mass spectrometer operates also at 0V and is under reduced pressure. Situated between the ion guide and the Q0 stage is a single modulating gating electrode. On the upstream side of the gating electrode (left side), there exists a high pressure region and on the other side of the gating electrode there is a low pressure region. The modulating gating electrode switches between two voltages, a first voltage that prevents ions from passing through the gating electrode (50V) and a second voltage (0V) that allows ions to pass through the electrode from the ion guide to Q0. While these two potentials have been specifically described, it would be appreciated that other voltages could also be utilized to achieve the same effect depending on the potentials applied to the ion guide and Q0 quadrupoles. As would be appreciated, various controller and power supplies are electrical connections are required so to provide and control the voltages being applied to the gates, ion guide, tandem mass spectrometer and/or other devices that are utilized.

It has been found that on the high pressure side, ions are driven by gas flow which results in ion mobility effects and that on the lower pressure side, the ion effects are primarily electrostatic. The modulation of a gating electrode with this configuration creates a localized electric field in a zone of perturbation on either side of the electrode. This electric field causes ions that have high ion mobility properties to be detrimentally affected causing their trajectories to deviate to an unstable trajectory. As ion mobility properties are dependent on the presence of gas, the ion mobility effects in this configuration are more closely felt on the upstream (higher pressure) side of the electrode.

Figure 2:
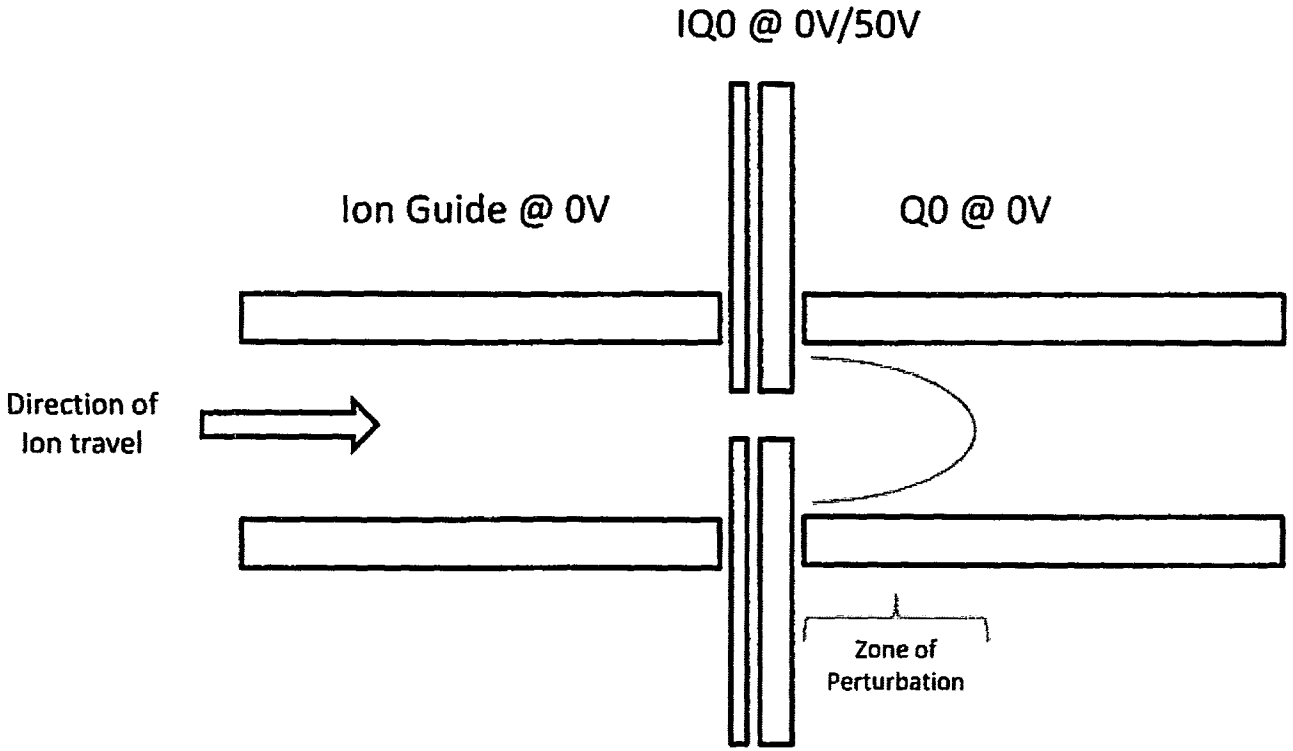
FIG. 2 depicts a layout of an embodiment of a dual gating lens

FIG. 2 shows the layout of an embodiment of a gating mechanism in accordance with the present teachings. The gating mechanism operates between an ion guide and the first stage of a tandem mass spectrometer, referred to commonly in the art as Q0 as described previously in FIG. 1 with the exception that the single modulating electrode is replaced with an assembly containing two electrode lenses. The first electrode lens which operates on the high pressure side of the assembly and in FIG. 2 is adjacent to the ion guide at 0V operates at a fixed potential of 0V. This first lens operates continuously at this fixed potential. The potential is chosen so as to allow ions to pass through the first lens. In preferred embodiments, the potential of this first upstream lens operates at the same voltage as the ion guide preceding it. The second lens directly downstream for the first lens operates in a similar fashion to the modulating gate found in FIG. 1. The second lens operates at one of at least two voltages wherein in the first voltage, the gate prevents traversal of ions through itself (50V) and when operated at the second voltage, the gate allows traversal of ions through itself (0V). In preferred embodiments, the potential of this second voltage operates at the same voltage as the ion guide and first lens preceding it. The first lens is electrically separated from the second lens so the voltage supplied to one of the lenses is not transmitted to the other. The lenses can be separated by a fixed distance or alternatively an insulating material can be inserted between the two lenses to achieve the same effect. The first lens operating in a continuous mode at a fixed potential minimizes the modulation field that would normally be present on either side of the second lens from affecting ions on the high pressure zone in the zone of perturbation where ion mobility effects would normally affect the distribution of ions as they approach the ion gate. While a zone of perturbation still exists on the lower pressure side of the gate, the reduced amount of gas present also reduces any ion mobility effects that might be present. While specific voltages are shown, as would be appreciated, any voltages could be used so long as the functionality of the lens is not impeded. For instance, what is of importance is that a bias exists between the electrodes to prevent the ions from traversing the gate when it is desired to prevent the ions from traversing the gate, and that no bias exists between the various electrodes when it is desired to allow ions to travel through the gates.

Figure 3:
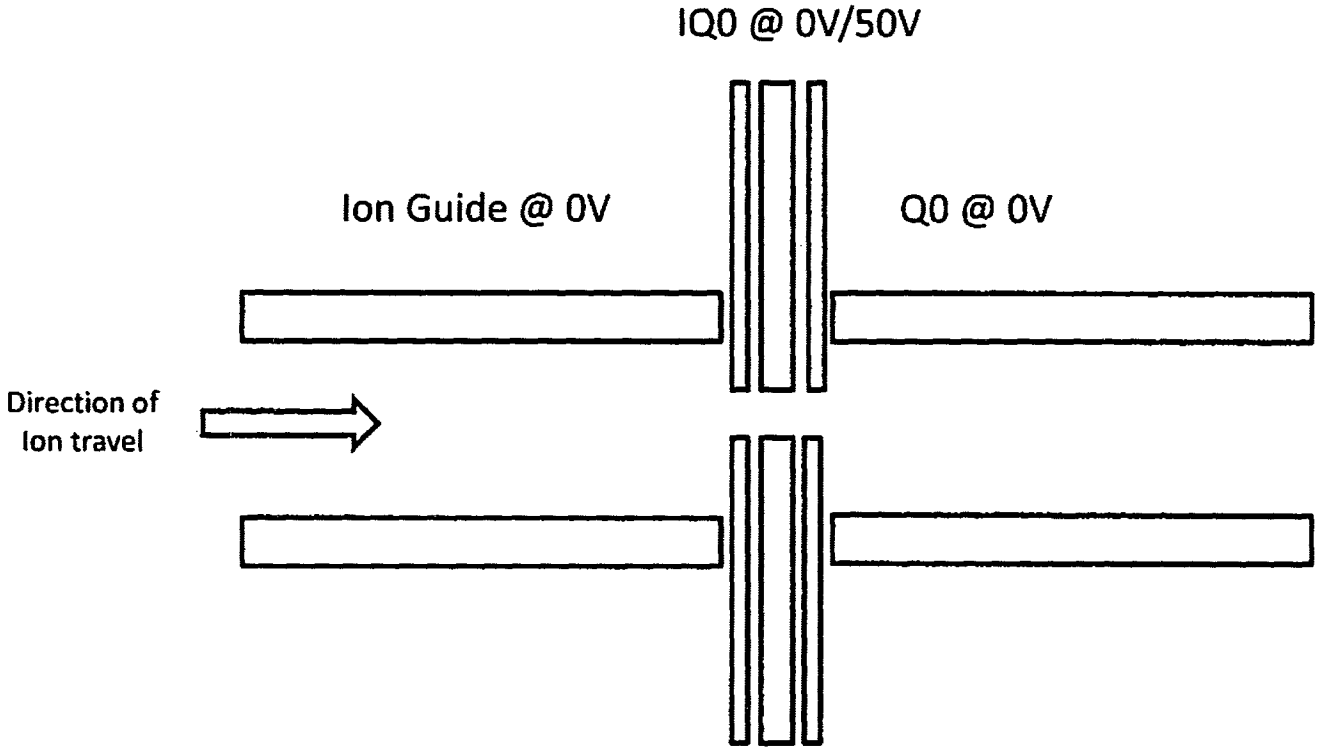
FIG. 3 depicts a layout of an embodiment of a triple gating lens

FIG. 3 shows the layout of another embodiment of the present invention similar to the embodiment described in FIG. 2, but the assembly contains a third lens electrode positioned downstream from the second lens electrode referred to above. The third electrode operates in a similar fashion to the first electrode and has a fixed voltage that allows traversal of ions through it. Due to the reduced pressure on the lower pressure side of the gate, this third electrode is not required as ion mobility effects as a result of a modulating electric field may be small or non existent in any event. In preferred embodiments, this third electrode operates at the same potential as the first electrode.

Figure 4:
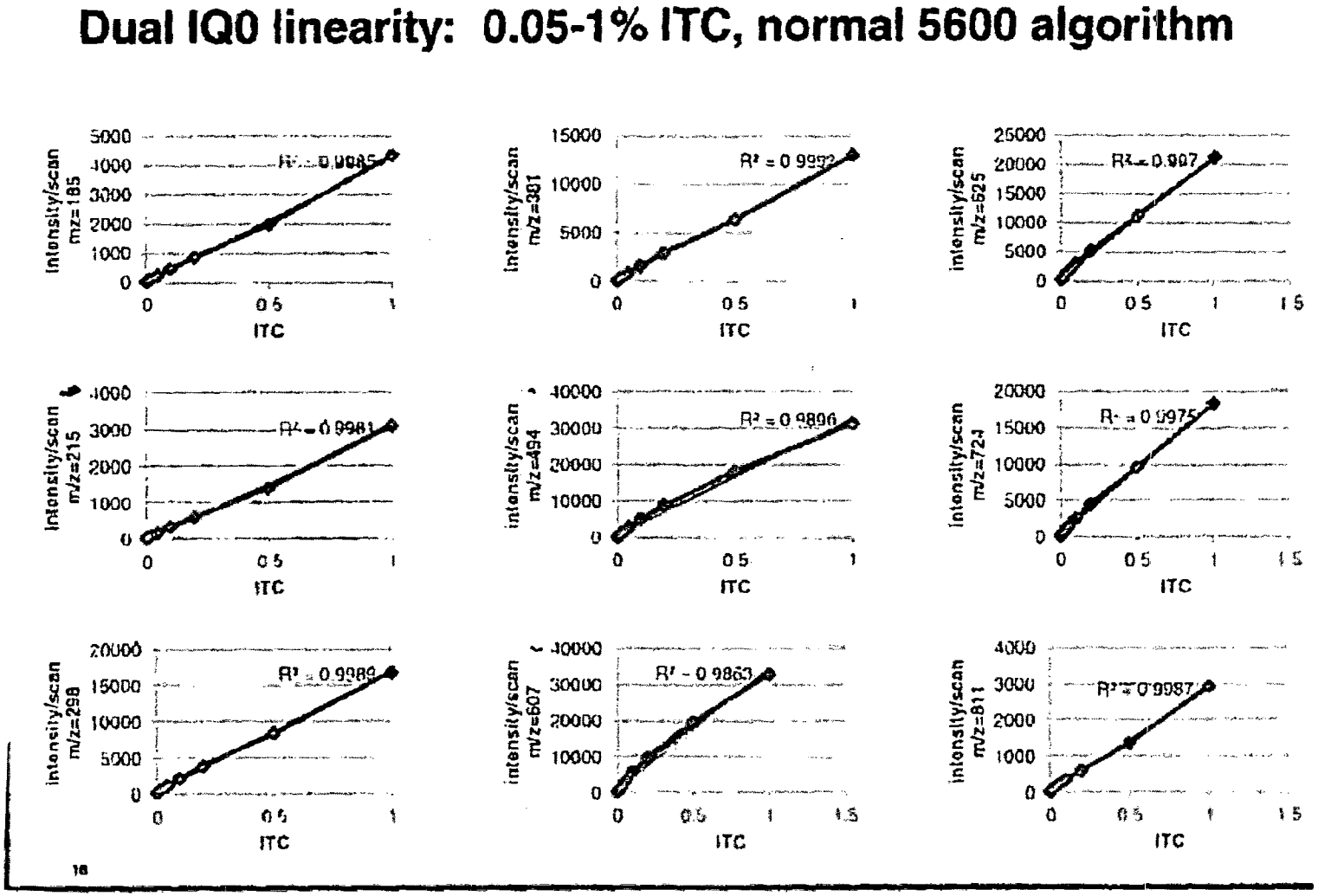
FIG. 4 depicts plots of various masses of intensity vs. modulation time for a gate.

FIG. 4 shows the linearity of plots of intensity as a function of the modulation for various ion masses. The ions were generated from the fragmentation of peptides, all using the same voltage and the data was acquired all at the same time. The x-axis for each of these plots provides the percentage of time in which the second lens operates at a voltage in which ions are allowed to pass through the gate as a percentage of total time. The coefficient of determination ($R^2$) for each of these plots is around 0.99 indicating a very high degree of linearity in the plots visualized. Any slight deviations in linearity were primarily in plots having high intensity counts that were likely a result of saturation effects on the detectors.

It would be appreciated that while specific embodiments have been disclosed that are a two and three element gates, it would be appreciated by the skilled person that this is only exemplary and that more elements can be utilized without departed from the claimed invention.

The invention claimed is:

1. A method for transmitting ions in a mass spectrometer from a region of higher pressure to a region of lower pressure comprising passing the ions through a gating apparatus disposed between said higher pressure region and said lower pressure region, the gating apparatus comprising:

first and second electrostatic lenses, each of said lenses being operably controlled by one or more controllers capable of maintaining different voltages on each of said lenses;

wherein the first lens is disposed adjacent to the region of higher pressure and having a voltage that is fixed at a predetermined value that allows traversal of ions through the first lens, and the second lens is disposed adjacent to the region of lower pressure and being situated downstream from said first lens, said second lens having a voltage that varies between at least two different voltages wherein in the first voltage, the ions can traverse through said second lens and in said second voltage, the ions are preventing from traversing through said second lens.

2. The method of claim 1 wherein a third electrostatic lens is disposed downstream from the second lens and operates at a predetermined value that allows traversal of ions through the third lens.

3. The method of claim 2 wherein the voltages on the first and third lenses are the same.

4. The method of claim 1 wherein the region of higher pressure is in an atmospheric pressure ion guide.

5. The method of claim 1 wherein the region of lower pressure is in a Q0 stage of a tandem mass spectrometer.

6. The method of claim 1 wherein the region of lower pressure is in a quadrupole ion trap.

7. The method of claim 1 wherein the region of lower pressure is in a TOF mass spectrometer.

8. A mass spectrometer device comprising:

an ion guide operating at a first pressure;

an ion trap operating at a second pressure that is lower than the first pressure;

a gating apparatus disposed between said ion guide and said ion trap for transmitting ions from said ion guide to said ion trap, said gating apparatus comprising a first electrostatic lens and a second electrostatic lens, the first lens being situated adjacent to the ion guide and the second lens being adjacent to said ion trap;

at least one controller for operably controlling the voltages on each of the first and second lens separately, wherein the controller is configured to maintain the first lens at a predetermined voltage that allows traversal of ions through said first electrostatic lens and the second lens in at least two different voltages in which at the first voltage, ions can traverse through said second lens and at said second voltage, the ions are preventing from traversing through said second lens.

9. The mass spectrometer device of claim 8 wherein said gating apparatus comprises a third lens disposed downstream from said second lens.

10. The mass spectrometer device of claim 9 wherein the voltages on said third and first lenses are the same.

11. The mass spectrometer device of claim 9 wherein the voltages on said third and first lenses are the same.

12. A mass spectrometer device comprising:

an ion guide operating at a first pressure;

a Time-of-Flight (TOF) mass spectrometer operating at a second pressure that is lower than the first pressure;

a gating apparatus disposed between said ion guide and said TOF mass spectrometer for transmitting ions from said ion guide to said TOF mass spectrometer, said gating apparatus comprising a first electrostatic lens and a second electrostatic lens, the first lens being situated adjacent to the ion guide and the second lens being adjacent to said TOF mass spectrometer;

at least one controller for operably controlling the voltages on each of the first and second lens separately, wherein the controller is configured to maintain the first lens at a predetermined voltage that allows traversal of ions through said first electrostatic lens and the second lens in at least two different voltages in which at the first voltage, ions can traverse through said second lens and at said second voltage, the ions are preventing from traversing through said second lens.

13. The mass spectrometer device of claim 12 wherein said gating apparatus comprises a third lens disposed downstream from said second lens.

* * * * *